United States Patent [19]

Goenner

[11] 3,991,594

[45] Nov. 16, 1976

[54] ANTI THEFT LOCKING SYSTEM

[76] Inventor: Albert O. Goenner, 9300 Old Georgetown Road, Bethesda, Md. 20014

[22] Filed: Dec. 27, 1974

[21] Appl. No.: 536,855

[52] U.S. Cl. ..... 70/30; 70/53

[51] Int. Cl.[2] ..... E05B 37/06

[58] Field of Search ..... 70/1.5, 23, 30, 49, 70/53, 288, 312; 109/20, 25, 29, 30, 31, 32, 33, 34; 128/2.05 C

[56] References Cited

UNITED STATES PATENTS

| | | | |
|---|---|---|---|
| 1,541,585 | 6/1925 | Moritz | 70/53 X |
| 2,578,556 | 12/1951 | Johnston | 109/31 X |
| 3,264,851 | 8/1966 | Kimball | 70/312 |
| 3,279,459 | 10/1966 | Schenker | 128/2.05 C |
| 3,435,642 | 4/1969 | DelPesco | 70/49 |

FOREIGN PATENTS OR APPLICATIONS

| | | | |
|---|---|---|---|
| 563,342 | 11/1932 | Germany | 109/29 |

*Primary Examiner*—Robert L. Wolfe

[57] ABSTRACT

An anti theft locking system including a tubular container charged with an irritant and dye with a locking device to interconnect the ends of the container in a closed loop.

10 Claims, 9 Drawing Figures

ANTI THEFT LOCKING SYSTEM

BACKGROUND OF THE INVENTION

This invention pertains generally to locking devices and more particularly to locking devices having a flexible, elongated member with a locking device to interconnect the ends thereof and form a closed loop. Devices of this type are commonly used to immobilize portable items or equipment such as typewriters, televisions, bicycles or the like, or to interconnect moveable members such as gates, doors or other components where it is desired to selectively immobilize or fix motion therebetween. The annular locking device of this invention is also applicable to uses where throughlock connections must be made such, for example, where it is desired to selectively lock electrical or fluid conductors at interconnecting points to one another or to a panel or other device.

A problem with the prior art devices to which this invention pertains, is that the elongated member can be readily severed with easily available tools. Armored cable and hardened chain make such breaking more difficult, however, bolt cutters or hacksaws will defeat such protection. Electrical circuits have been devised to provide an alarm in conjunction with these types of locks, however, this solution requires bulky and relatively complex attachments and the need for electrical power.

SUMMARY OF THE INVENTION

This invention provides an anti theft locking device having a passive, thief repelling and/or identifying fluid ejector which is actuated upon attempt to break the locking device.

The invention also provides a tubular lock which is suitable for interconnecting and selectively immobilizing elongated members such as fluid, electric or heat conducting cables to one another or to other devices.

In a preferred embodiment, the invention provides an anti theft locking system including a flexible tubular container charged with a pressurized propellant carrying a dye and/or irritant and interconnected at the ends thereof by a tubular locking device through which the container extends.

The objects and other advantages of the invention will become better understood to those skilled in the art by reference to the following detailed description when viewed in light of the accompanying drawings wherein like numerals throughout the figures thereof are indicative of like components and wherein:

DESCRIPTION OF PREFERRED EMBODIMENT

Figure 1:
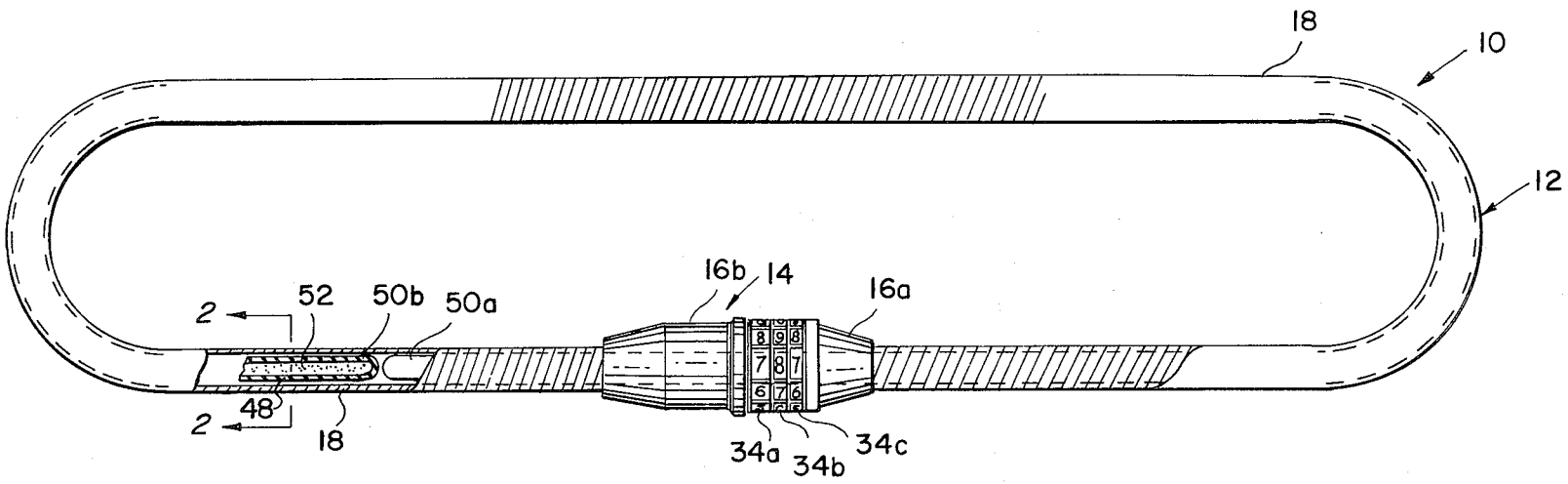
FIG. 1 is a view, partly in section, of an embodiment in accordance with the invention.
Figure 2:
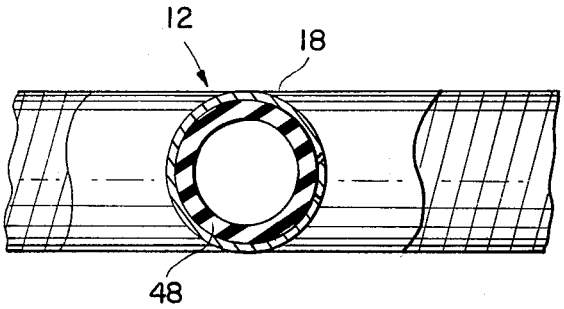
FIG. 2 is a sectional view of FIG. 1 taken along the line 2—2 thereof.

In FIG. 1, the locking system 10 comprises an elongated flexible tubular member, shown generally at 12, and a locking device, generally indicated by 14, providing locking interconnection of the ends of the member 12 to form a closed loop as shown. The locking device is composed of a male lock component 16*a* associated with one end of the member 12 and a female lock component 16*b* associated with the other end of the member. As can be best seen in the sectional portion of FIG. 1 and by reference to FIG. 2, the member 12 includes an outer tubular sheath 18, formed of suitable flexible, nonstretch, wear and damage resistant material such, for example, as helically wound "armored cable" type steel, braided wire, cord plastic or the like. The main function of the sheath is to protect its contents against mechanical damage, wear and/or elongation as will be described in greater detail below.

Figure 3:
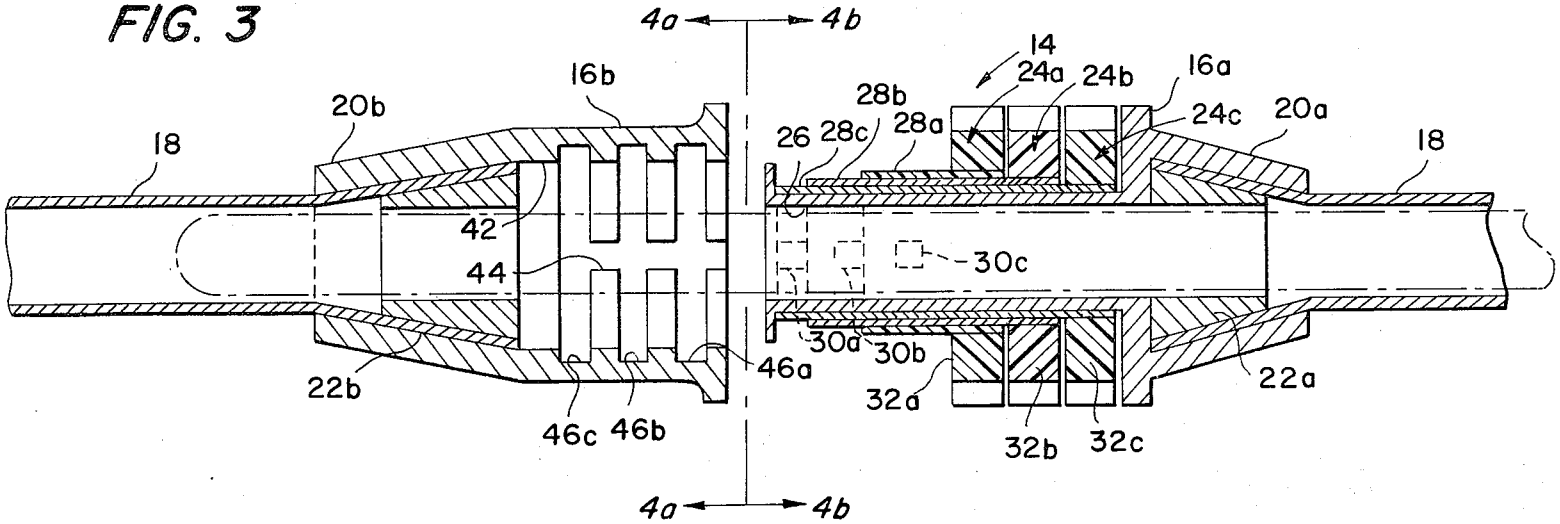
FIG. 3 is a fragmentary view, in section, of a portion of the structure of FIG. 1.

As can be best seen in FIG. 3, the sheath 18 terminates at each end in components 16*a* and 16*b* of the locking device 14. Termination may be accomplished by any suitable means so long as the interior diameter of the tubular passage formed by the sheath 18 is not reduced thereby. As shown, connection is effected in the embodiment illustrated by flaring the ends of the sheath 18 and fixing them to the components within conical portions 20*a* and 20*b* with wedge bushings 22*a* and 22*b* in a manner well known in the art.

Figure 4A:
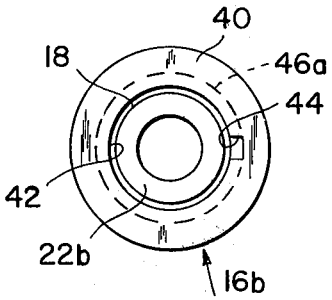
FIGS. 4*a* and 4*b* are ends views of the structure as shown in FIG. 3 taken from the lines 4*a*—4*a* and 4*b*—4*b* thereof.
Figure 4B:
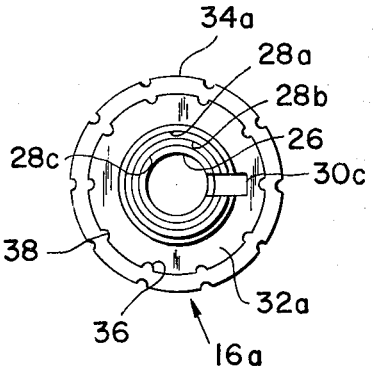
Figure 5A:
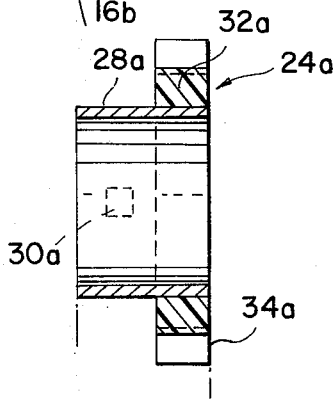
FIGS. 5*a* 5*b* and 5*c* are detailed sectional views of elements of the structure shown in FIG. 3.
Figure 5B:
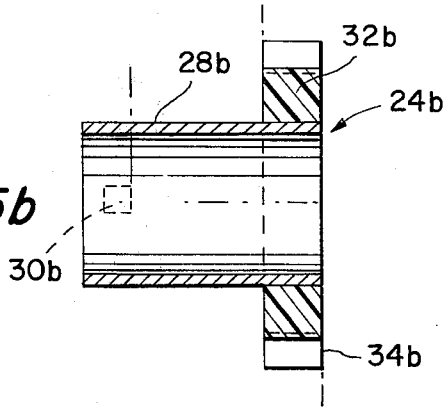

Best seen in FIGS. 3, 4*b* and 5*a* through 5*c* the component 16*a* of the locking device 14 comprises a series of concentrically disposed tubular tumblers 24*a*, 24*b*, and 24*c* arranged around a tubular projection 26 extending from the conical portion 20*a*. Each tumbler comprises, respectively, a barrel portion 28*a*, 28*b*, and 28*c* from which a key 30*a*, 30*b* and 30*c* are of decreasing diameter and of increasing length in that order so that they may be nested in one another with their respective keys 30*a*, 30*b* and 30*c* longitudinally spaced as shown in the figures. The radial heights of the keys 30*a*, 30*b* and 30*c* increase in that order so that the relative height of the keys, when assembled, is substantially equal. A turning ring 32*a*, 32*b* and 32*c* is fixed to the barrels 28*a*, 28*b* and 28*c* at the ends thereof opposite the keys. A snap ring 34*a*, 34*b* and 34*c*, having numbers on the periphery thereof, is disposed over the respective turning rings 32*a*, 32*b* and 32*c*. As best seen in FIG. 1, the rings are numbered from 0 to 9 to provide an external indication of the rotational position of the respective keys 30*a*, 30*b* and 30*c*. As is best seen in FIG. 4*b*, the interior surface of the snap ring 34*a* is provided with a series of radial projections 36 while the exterior surface of the turning ring 32*a* is furnished with a corresponding series of serrations 38 which receive the projections 36. By this means the snap rings can removably engage the turning rings to provide mechanical interconnection and, yet, removable for reindexing to change the lock combination by changing the relative position of the snap ring number and the key.

The female lock component 16*b* comprises a cylindrical housing 40 extending from the conical portion 20*b* having an internal bore 42 of diameter sufficient to just accept the largest diameter barrel portion 28*a* of the male lock component 16*a*. The bore 42 is provided with a longitudinally extending keyway 44 which is sized to accept the keys 30*a*, 30*b* and 30*c* when they are aligned as shown in FIG. 3. A series of annular grooves 46*a*, 46*b* and 46*c* are formed in the bore 42 to intersect the keyway 44 at points of identical spacing to the assembled spacing between the keys 30*a*, 30*b* and 30*c* such that, upon connection of the lock components 16*a* and 16*b* as in FIG. 1 and rotation of one or more of the keys 30*a*, 30*b* or 30*c* from the aligned condition shown in FIG. 3, the keys will enter into their respective annular grooves 46*a*, 46*b* or 46*c* thereby locking the ends of the member 12 together.

The structure thus far described not only provides a relatively continuous structure for locking objects but it also provides a tubular locking device having a continuous, uninterrupted bore through the lock for important purposes to be described below.

Referring again to FIGS. 1 and 2, a tubular, flexible cartidge 48 having closed ends 50*a* and 50*b* is disposed in the sheath 18. The cartridge provides a pressure tight container and is charged with a pressurized propellant such as a halogenated hydrocarbon marketed under the Dupont trademark "FREON" or the like to provide a pressure discharge upon rupture of the cartridge 48. A dye and/or irritant is mixed with the propellant to be discharged therewith upon rupture of the cartridge. Suitable irritants would be noxious but relativey harmless substances such, for example, as pepper or the like. The dyes would be indelible or insoluable in water and of the brighter hues to mark and identify individuals attempting to break the locking device. The cartridge 48 is preferably made of a synthetic material such as butyl rubber or the like, however, any flexible material compatible with the described environment can be used for this purpose.

Figure 6:
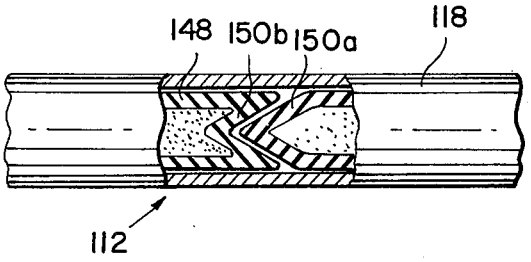
FIG. 6 is a fragmentary view, in section, of a variation in accordance with the invention.
Figure 5C:
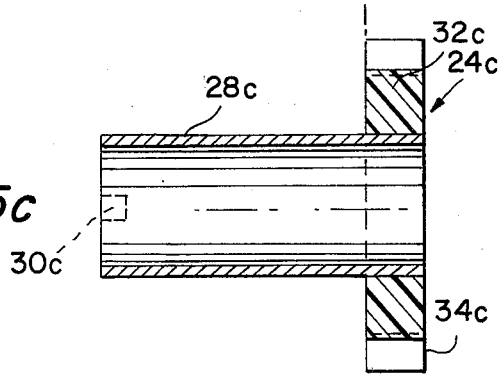

The cartridge 48 is formed in a length suitable to place the ends 50*a* and 50*b* in abutment when the device is connected as seen in FIG. 1. In this way, an attempt to sever the member 12 at any point other than the location of the abutting ends of the cartridge 48 will result in rupture of the cartridge with discharge of its contents. An important feature of this invention is that the above described structure provides the following capabilities. Firstly, the location of the abutting point within the sheath 18 can be varied from device to device so that this point is never predictable to anyone other than the lock user. This is accomplished by varying the relative positions of the cartridge and the sheath so that the amount of cartridge projecitng from either the male lock component 16*a* or the female component 16*b* varies from lock to lock. This variation is preferably accomplished during fabrication of the device and, once established, is maintained fixed by attaching the cartridge 48 to the sheath 18 by means of adhesive or the like. Some latitude for relative movement or replacement of the cartidge could be provided if so desired. The completely open, uninterrupted bore through the sheath 18 and the locking device 14 provides to ability to move the abutting point between the ends of the cartridge 48 without restriction. This feature also permits an intimate relationship between the ends of the cartridge which enables the variation illustrated in FIG. 6. In that figure, components corresponding to like components of the preceeding figures are indicated by like numerals of the next higher order. In the variation shown, the ends of the cartridge 148 are formed with complementary shapes (i.e., 105*b* beng concave and 150*a* convex) so that they are "nested" in one another as shown. In this manner, a straight line cut through the member 112, even though carefully placed at the point of abutment, must rupture the cartridge 148. Obviously other complimentary forms of the ends of the cartridge will accomplish the above objectives.

What has been described above is intended to be exemplary of a teaching in accordance with the invention to aid those skilled in the art in the practice thereof.

What is new and desired to be protected by Letters Patent of the United States is:

1. An anti theft locking system comprising:
a flexible tubular member having closed ends defining a pressure tight container;
a pressurized charge in said container; and
locking means comprising tubular, nesting male and female components, each having walls defining coaxial bores therethrough associated with said member and receiving said container completely therethrough for providing locking interconnection of the ends thereof.

2. A system in accordance with claim 1 further comprising an indelible marking dye carried by said pressurized charge.

3. A system in accordance with claim 2 further comprising a noxous substance carried by said pressurized charge.

4. A system in accordance with claim 1 wherein said tubular member comprises an outer protective sheath and an inner elastomeric sealed cartridge containing said pressurized charge.

5. A system in accordance with claim 4 wherein said locking means comprises complimentary male and female components fixed to opposite ends of said sheath.

6. A system in accordance with claim 5 wherein said components are tubular with an internal bore therethrough substantially equal in diameter to the interior diameter of said sheath and wherein said components are coaxially disposed on said sheath such that, upon connection of said components, an uninterrupted bore is provided through said system.

7. A system in accordance with claim 6 wherein said cartridge is coextensive with said sheath and said locking components.

8. A system in accordance with claim 7 wherein the ends of said cartridge are displaced from the ends of said sheath.

9. A system in accordance with claim 7 wherein the ends of said cartridge have complimentary form to nest when disposed in abutting relationship such that a straight line cut thrugh said cartridge at the point of abutment of the ends thereof will penetrate said cartridge.

10. In a combination lock of the type having a male component with plural, coaxial, nested, rotatable barrels having radially extending keys thereon and a female component having walls defining a bore therein with axially and circumferentially extending keyways for receiving and releasing the keys of the male component when the keys are correctly aligned and for retaining the male component therein when the keys are aligned in another configuration, the improvement comprising;
walls defining coaxial bores through said components;
a first member connected to said male component to be communicative with the bore therein; an
a second member connected to said female component to be communicative with the bore therein and the bore of said male component when said male component is retained in said female component;
whereby lockable communications provided between said members.

* * * * *